US007703170B2

(12) United States Patent
Orubor

(10) Patent No.: US 7,703,170 B2
(45) Date of Patent: Apr. 27, 2010

(54) SELF-CLEANING WET DRY VACUUM CLEANING DEVICE

(76) Inventor: Lawrence Orubor, 35 Lake Sylvan Close SE., Calgary, Alberta (CA) T2J 3E5

( * ) Notice: Subject to any disclaimer, the term of this patent is extended or adjusted under 35 U.S.C. 154(b) by 1079 days.

(21) Appl. No.: 11/027,668

(22) Filed: Dec. 29, 2004

(65) Prior Publication Data

US 2006/0137132 A1 Jun. 29, 2006

(51) Int. Cl.
*A47L 9/00* (2006.01)

(52) U.S. Cl. ..... 15/320; 15/322; 15/344

(58) Field of Classification Search ..... 15/320–322, 15/344; *A47L 9/00*

See application file for complete search history.

(56) References Cited

U.S. PATENT DOCUMENTS

| | | | | |
|---|---|---|---|---|
| 2,589,020 | A | 3/1952 | North | |
| 2,841,923 | A | 7/1958 | Dickison | |
| 2,928,601 | A | 3/1960 | Fenimore | |
| 3,680,504 | A | 8/1972 | Seebald | |
| 3,753,408 | A | 8/1973 | Zimmerman | |
| 3,770,204 | A | 11/1973 | Schuster | |
| 3,808,631 | A * | 5/1974 | Shibata et al. | 15/321 |
| 3,968,937 | A | 7/1976 | Miller | |
| 4,152,080 | A | 5/1979 | Clark, Jr. | |
| 4,302,040 | A | 11/1981 | Lazar | |
| 4,478,448 | A | 10/1984 | Albert | |
| 4,549,329 | A | 10/1985 | St. Clair | |
| 4,610,048 | A | 9/1986 | Ishihara | |
| 4,744,380 | A | 5/1988 | Sheriff | |
| 4,788,738 | A | 12/1988 | Monson et al. | |
| 4,809,396 | A | 3/1989 | Houser | |
| 4,863,108 | A | 9/1989 | Mitchell | |
| 4,948,266 | A | 8/1990 | Bencic | |
| 4,957,131 | A | 9/1990 | Robinson | |
| 5,206,970 | A | 5/1993 | Johnson | |
| 5,392,490 | A * | 2/1995 | Monson | 15/320 |

(Continued)

FOREIGN PATENT DOCUMENTS

| | | |
|---|---|---|
| CA | 2453737 | 12/2003 |

(Continued)

OTHER PUBLICATIONS

Supplemental European Search Report for PCT/CA2005/001929 dated Jul. 28, 2008, 12 pages.

(Continued)

*Primary Examiner*—David A Redding
(74) *Attorney, Agent, or Firm*—Blakely, Sokoloff, Taylor & Zafman LLP

(57) ABSTRACT

A self-cleaning wet dry vacuum cleaning device for collecting and disposing of waste material and specifically animal waste, the device including a waste collection system for collecting and breaking up the waste, the waste collection system including a self-cleaning intake nozzle, a vacuum in communication with the waste collection system for providing suction to the intake nozzle, a waste storage system in communication with the vacuum for storing waste vacuumed into the intake nozzle, a fluid dispensing system having a fluid reservoir including a piston system, the piston system for consistently dispensing fluid from the fluid reservoir to the intake nozzle and a leash system, all of which are all integrated with or removably engageable with the device's body.

20 Claims, 14 Drawing Sheets

U.S. PATENT DOCUMENTS

| | | | | |
|---|---|---|---|---|
| 5,432,975 | A | 7/1995 | Hilmanowski | |
| 5,500,978 | A | 3/1996 | Levine | |
| 5,540,469 | A | 7/1996 | Albert | |
| 5,561,884 | A * | 10/1996 | Nijland et al. | 15/321 |
| 5,866,186 | A | 2/1999 | Bazan | |
| 5,970,572 | A | 10/1999 | Thomas | |
| 6,032,995 | A | 3/2000 | Barbaro | |
| 6,077,362 | A | 6/2000 | Reed | |
| 6,079,076 | A | 6/2000 | Berfield | |
| 6,171,375 | B1 * | 1/2001 | Howie | 96/17 |
| 6,347,428 | B1 | 2/2002 | Shimko et al. | |
| 6,367,714 | B1 | 4/2002 | Smoot | |
| 6,493,903 | B1 | 12/2002 | Super | |
| 6,874,197 | B1 | 4/2005 | Conrad et al. | |
| 7,073,226 | B1 * | 7/2006 | Lenkiewicz et al. | 15/320 |
| 7,225,503 | B1 * | 6/2007 | Lenkiewicz et al. | 15/320 |
| 7,272,869 | B1 | 9/2007 | Robinson | |
| 7,341,612 | B2 * | 3/2008 | Nhan et al. | 55/373 |
| 2001/0005919 | A1 | 7/2001 | Worden et al. | |
| 2002/0042965 | A1 * | 4/2002 | Salem et al. | 15/339 |
| 2002/0066153 | A1 | 6/2002 | Sciafani et al. | |
| 2002/0092122 | A1 | 7/2002 | Zahuranec | |
| 2003/0131439 | A1 | 7/2003 | Wen | |
| 2003/0159233 | A1 | 8/2003 | Oh | |
| 2004/0083571 | A1 | 5/2004 | Yoo et al. | |
| 2004/0083572 | A1 | 5/2004 | Song | |
| 2004/0088816 | A1 | 5/2004 | Shimizu et al. | |
| 2005/0015916 | A1 | 1/2005 | Orubor | |
| 2006/0081027 | A1 | 4/2006 | Rhodes | |
| 2007/0204887 | A1 | 9/2007 | Wood | |

FOREIGN PATENT DOCUMENTS

| | | | |
|---|---|---|---|
| CN | 1178455 | A | 4/1998 |
| DE | 32 25 602 | A1 | 1/1984 |
| EP | 0 456 084 | A | 11/1991 |
| EP | 0 847 721 | A | 6/1997 |
| GB | 429106 | | 5/1935 |
| GB | 2 114 878 | A | 9/1983 |
| GB | 2145620 | * | 4/1985 |
| WO | WO 2004/107947 | | 12/2004 |

OTHER PUBLICATIONS

PCT International Search Report for PCT/CA2004/000841, dated Jul. 6, 2004, 4 pages.

The Patent Office of the People's Republic of China—,First Office Action for Application No. 200480019209.7, issue date Jul. 6, 2007.

The State Intellectual Property Office of the People's Republic of China, First Office Action for "Self-Cleaning Wet Dry Vacuum Cleaning Device", Application No. 200580047337.7, Issuing Date: Feb. 13, 2009, 20 pages.

* cited by examiner

SELF-CLEANING WET DRY VACUUM CLEANING DEVICE

FIELD OF THE INVENTION

The present invention relates generally to portable wet dry vacuum devices which allow for the safe and convenient collection of waste materials. More particularly, the present invention relates to a portable device for collecting animal waste and for providing a restraining device such as a leash for pets.

BACKGROUND OF THE INVENTION

In the prior art there have been a variety of handheld wet dry vacuum cleaners but few of these have been specifically designed for use with noxious waste material. Still fewer have been made readily available for pet owners who wish to clean up after their pets. Since few such cleaners have been made available, little development has been made in the area of a self-cleaning vacuum which ensures that the operator is not exposed to and does not have to handle any waste materials.

In the development of portable wet dry vacuums, various attempts have been made to develop a system integrated with the wet dry vacuum for the application of water, cleaning solution or other fluid to the area to be cleaned. While various previous attempts have been made, none of these references teach a system which can stabilize or reduce fluctuation in the supply of the fluid to ensure consistent application of the cleaning solution, especially when the level of water or cleaning solution is low or when there is excessive movement of the container holding such water or cleaning solution.

In the prior art there have been a number of solutions to try to help pet owners clean up waste material. Examples include devices such as modified scoops or gloves for waste material along with a form of disposal bag (or a scoop with an integrated disposal bag). However, none of these devices provide a convenient method for a pet owner to clean up the pet's waste without being exposed to the waste or possibly coming into contact with the waste. Further, these devices expose the pet owner to the smell of the waste which can be, at times, overwhelming. A further disadvantage of such devices is that they are not especially helpful at removing all of the pet waste. This can pose problems if the pet waste is located on public property or someone's private property or if in an area where children play.

SUMMARY OF THE INVENTION

It is an object of the present invention to teach a self-cleaning wet dry vacuum cleaning device which is designed to maximize the convenience of use for pet owners and which provides several advantages designed to meet the challenges of a portable vacuum device used for noxious waste materials.

It is another object of the present invention to overcome the disadvantages of prior art waste collection systems by providing an improved waste collection system which includes a vacuum and means to reduce the operator's exposure to the waste.

Other aspects and features of the present invention will become apparent to those ordinarily skilled in the art upon review of the following description of specific embodiments of the present invention.

BRIEF DESCRIPTION OF THE DRAWINGS

Embodiments of the present invention will be described by way of example only, with references to the attached figures where.

*Fig.* 13 is a cross sectional view of a leash system in accordance with the present invention.

Figure 14:
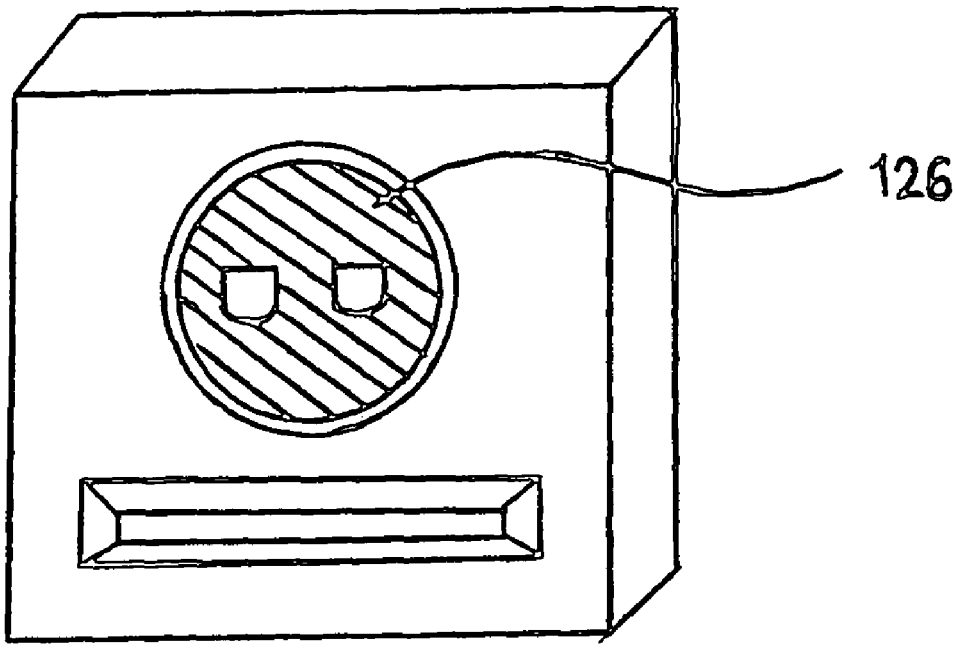

FIG. 14 is a perspective view of a leash system in accordance with the present invention.

DETAILED DESCRIPTION OF THE INVENTION

The present invention generally relates to a self-cleaning wet dry vacuum cleaning device 1 for the collection and disposal of noxious material. Such noxious material may include solid, liquid and mixed waste and particularly includes waste from animals, making the device particularly useful for pet owners wishing to clean up their pets' waste.

To maximize the convenience of use of the device for pet owners, the device includes a leash system 120 to allow the device to serve multiple functions, namely, a pet stool vacuum and storage unit and a leash. These functions and more particular embodiments of the device are described below.

The device generally includes a vacuum 100, a waste collection system 10, a fluid dispensing system 30, a waste storage system 60 and a leash system 120 which are all integrated with or removable engageable with the device's body.

Waste Collection System

Figure 1:
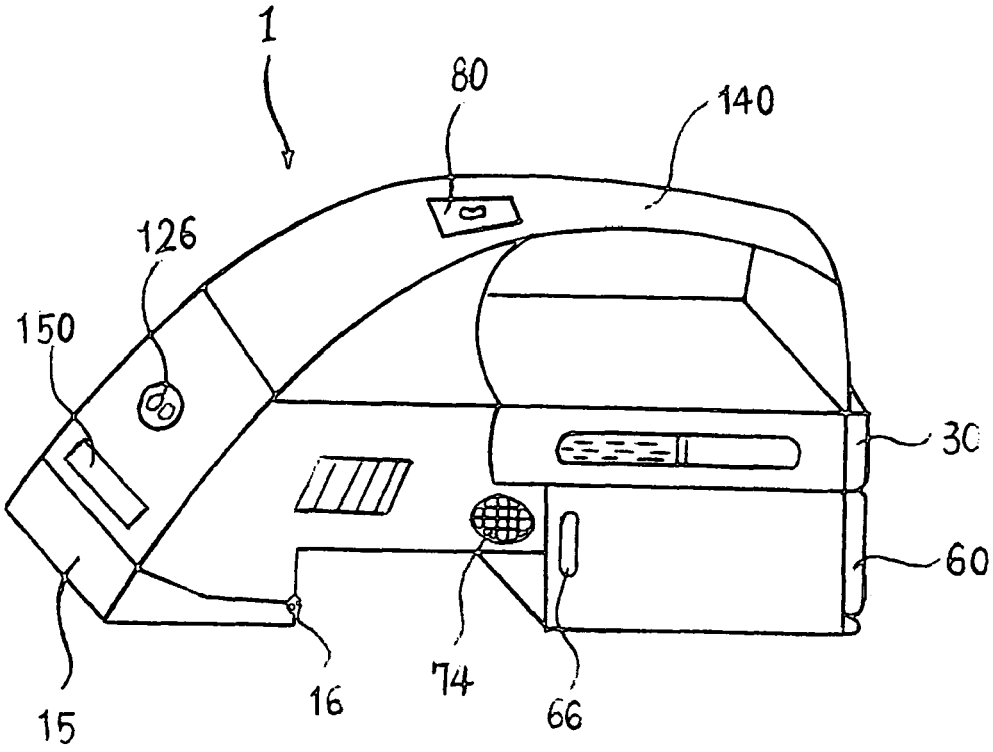
FIG. 1 is a perspective view of a device in accordance with the present invention.
Figure 2:
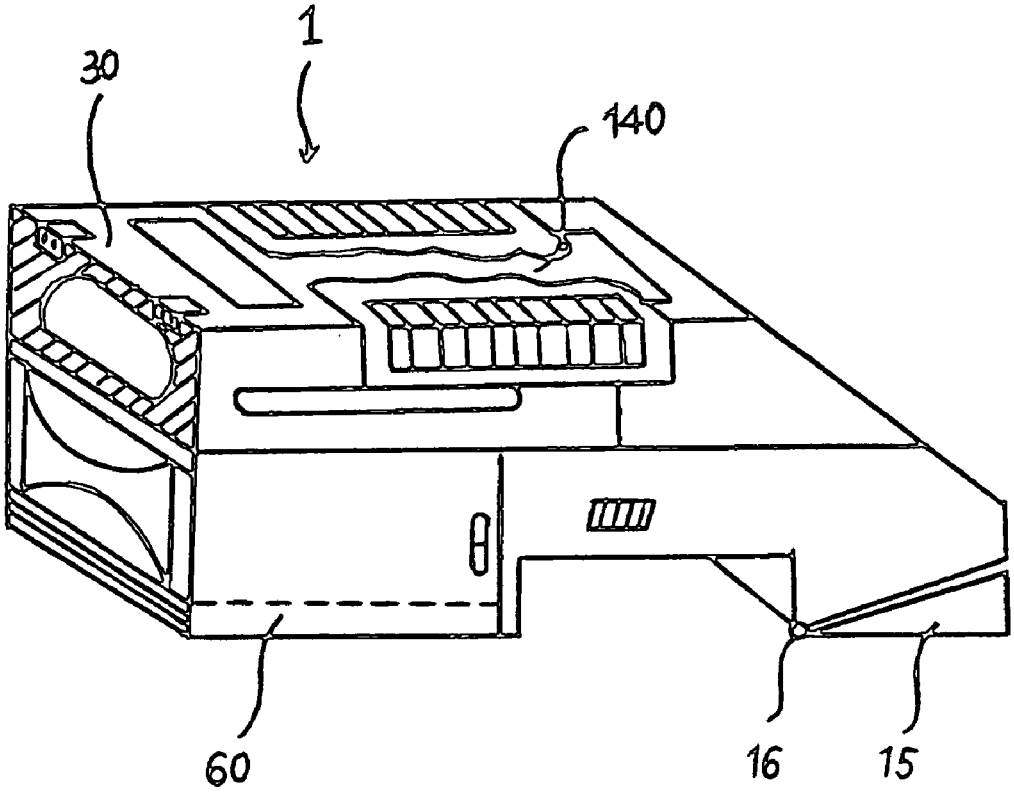
FIG. 2 is a rear perspective view of a device in accordance with the present invention.
Figure 3:
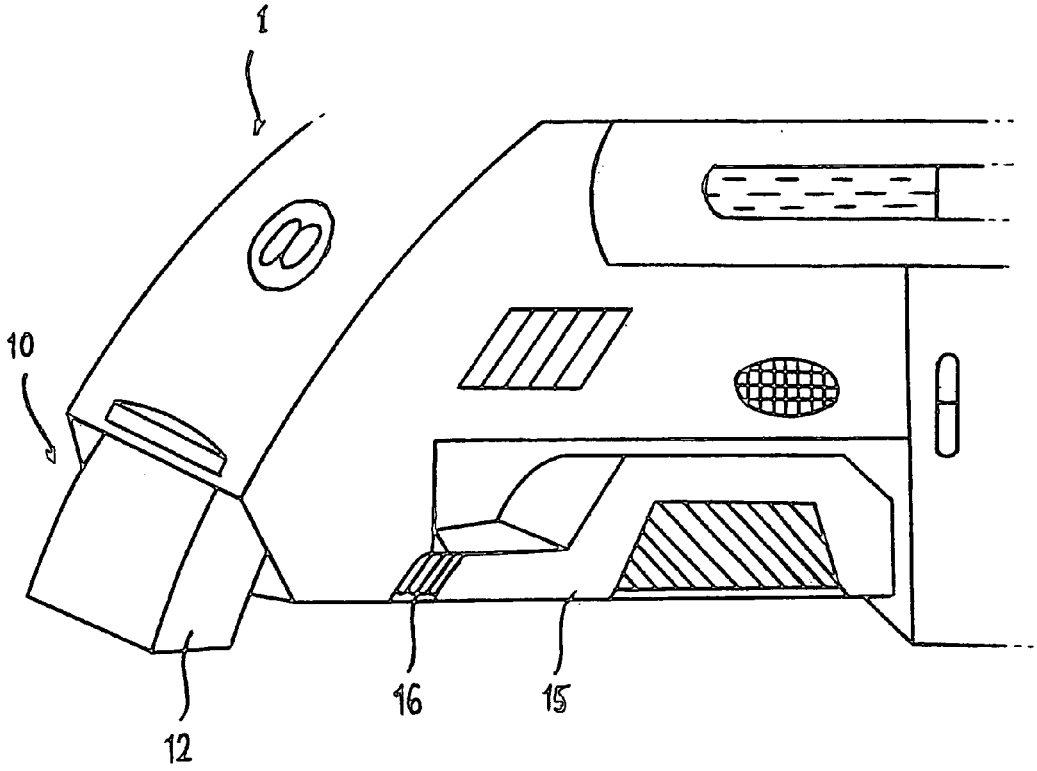
FIG. 3 is a perspective view of a device in accordance with the present invention.

The waste collection system 10 includes an intake nozzle 12 (which is movable between an extended position during operation (as shown in FIG. 3) and a retracted position when the device is off as shown in FIG. 1), a cover lid 15 hinged to the body of the device 1 (using hinge 16) for covering the intake nozzle 12 when the device 1 is off and for retracting to expose the intake nozzle 12 during operation, a collection hose 18 operatively connected to the intake nozzle 12 for allowing waste to travel from the intake nozzle 12 to a vacuum 100 and ultimately into the waste storage system 60, the collection hose 18 including at least one pressurized spray jet 19 in fluid communication with the fluid dispensing system 30 for spraying, lubricating and cleaning the interior of the collection hose 18. Alternatively, the spray jet 19 or jets may be located in the intake nozzle 12 as shown in FIG. 4.

Figure 4:
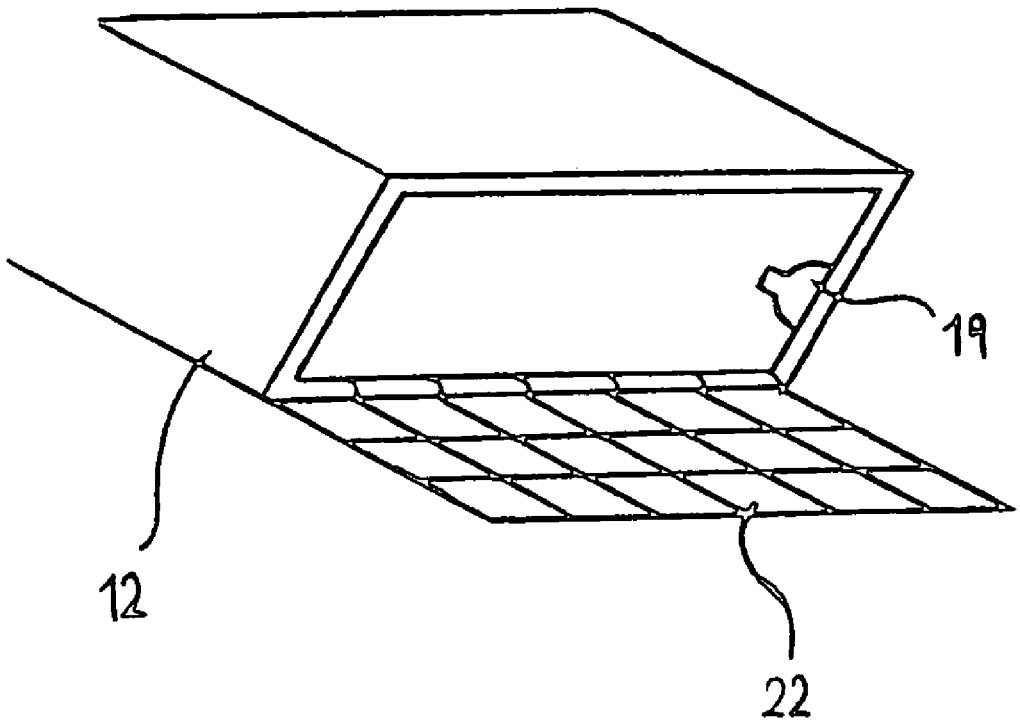
FIG. 4 is a perspective view of an intake nozzle in accordance with the present invention.

The waste collection system 10 may also include a cover grille 22 as shown in FIG. 4. The cover grille 22 is located near the opening of the intake nozzle 12 and is operable between an open position (FIG. 4) and closed position (now shown). The cover grille 22 prevents large materials from clogging the intake nozzle 12 or the collection hose 18. If the intake nozzle 12 or the collection hose 18 do become clogged, the cover grille 22 can be opened (through the use of various mechanical means such as a trigger-operated piston or through the use of electrical means which are not shown) to allow such material to fall out of the intake nozzle 12 or collection hose 18. In one embodiment the cover grille 22 is recessed within the intake nozzle 12 to ensure that any such discarded materials are cleaned by the spray jet 19 located in the intake nozzle 12 or the collection hose 18 prior to being discarded.

Optionally, a one-way valve 72 or a plurality of one-way valves may be located in the interior of the collection hose 18 to prevent waste within the collection hose 18 from travelling back towards the intake nozzle 12.

Fluid Dispensing System

The fluid dispensing system 30 generally includes a fluid reservoir 32 in communication with a spray pump 45, the fluid reservoir 32 including a piston system 34 for ensuring consistent dispensing of fluid from the fluid reservoir 32, the fluid reservoir 32 in fluid communication with hoses 47 for dispensing fluid to various systems within the device.

One particular use of the fluid dispensing system 30 is to provide fluid to the pressurized spray jet 19 or jets located within the intake nozzle 12 (or alternately located within the collection hose 18). Such a spray jet 19 can lubricate and clean the interior of the intake nozzle 12 or collection hose 18 and help dissolve and separate waste material to increase the efficiency of the device's vacuum 100. In another embodiment, a spray jet 19 is located in the cover lid 15 thereby serving as a wash basin for cleaning the intake nozzle 12 when the operator has finished using the device 1 to collect waste.

The fluid reservoir 32 many include a straining basket 40 or other retaining means for containing a concentrated bar of cleaner to create fluid for the fluid reservoir 32 upon the addition of water to the fluid reservoir 32 through the basket 40.

Figure 6:
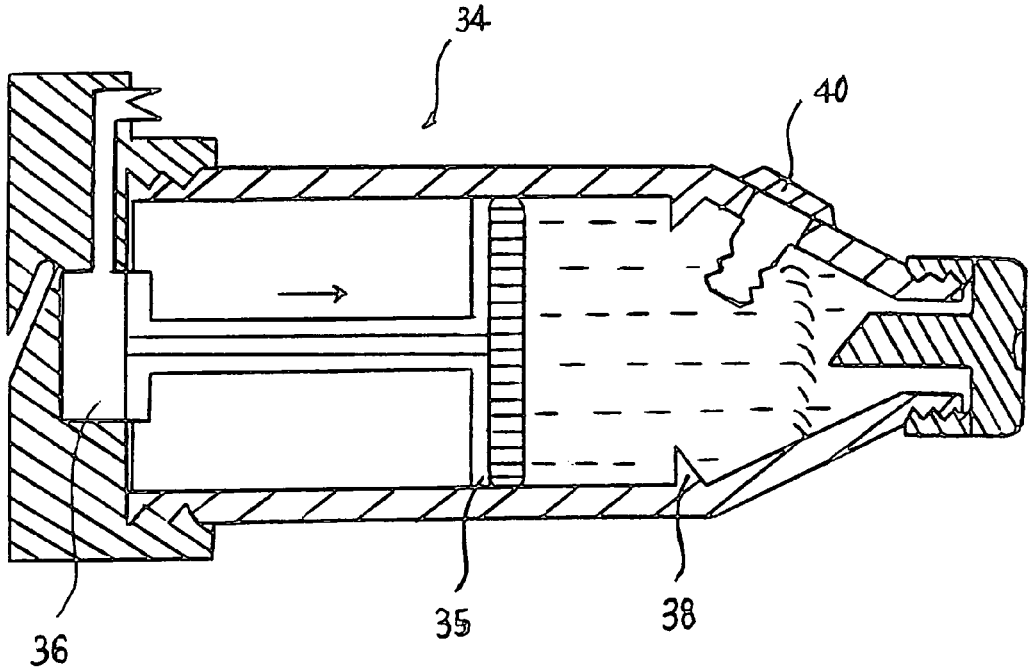
FIG. 6 is a cross sectional view of a piston system in accordance with the present invention.
Figure 7:
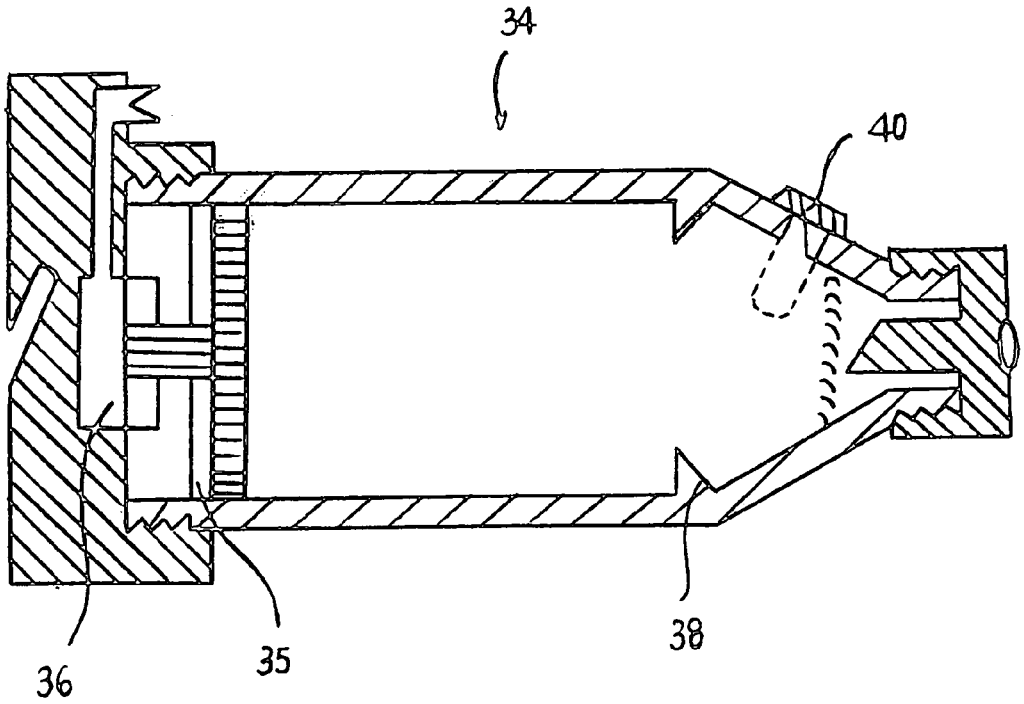
FIG. 7 is a cross sectional view of a piston system in accordance with the present invention.
Figure 8:
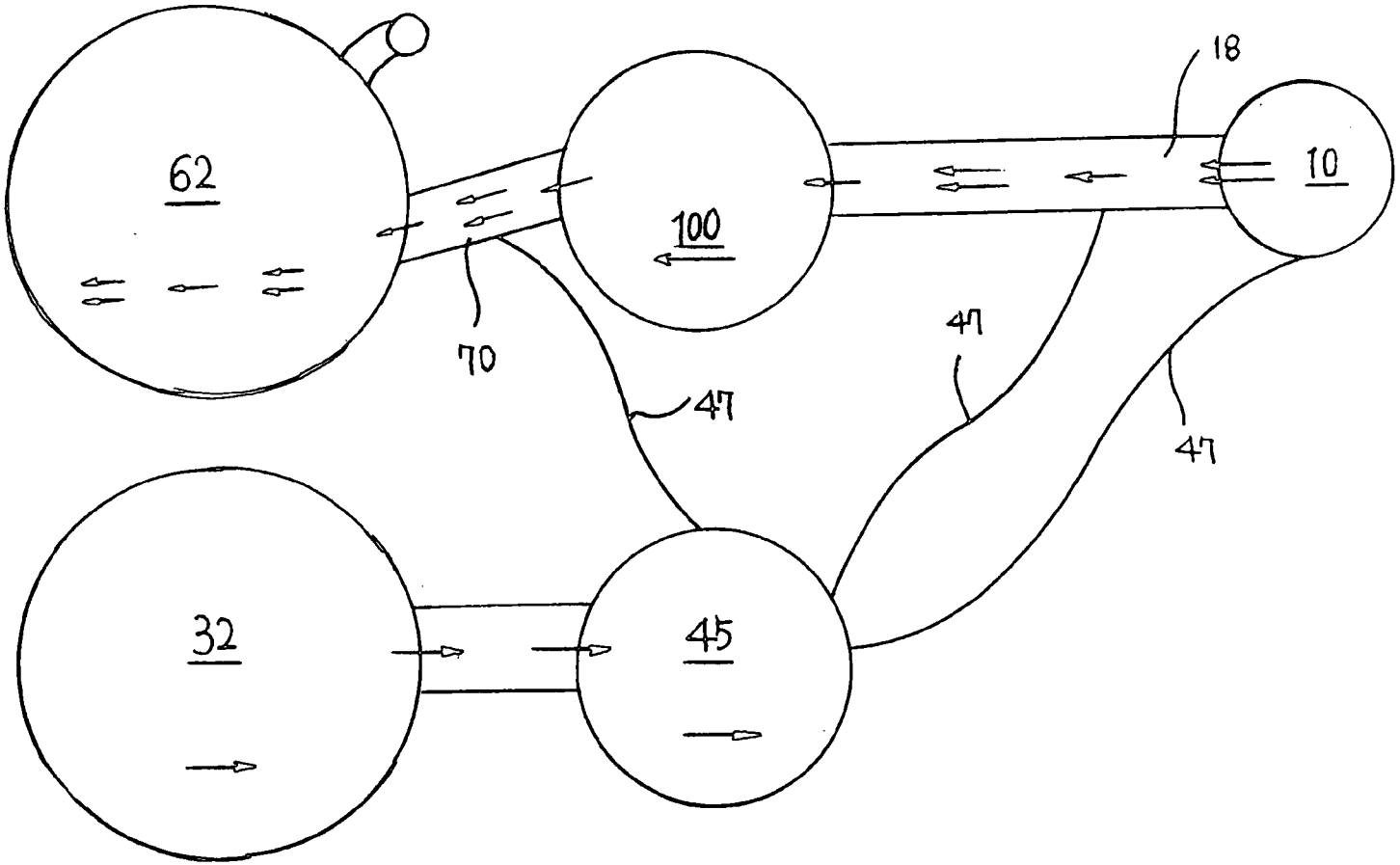
FIG. 8 is a schematic of the internal operation of a device in accordance with the present invention.
Figure 9:
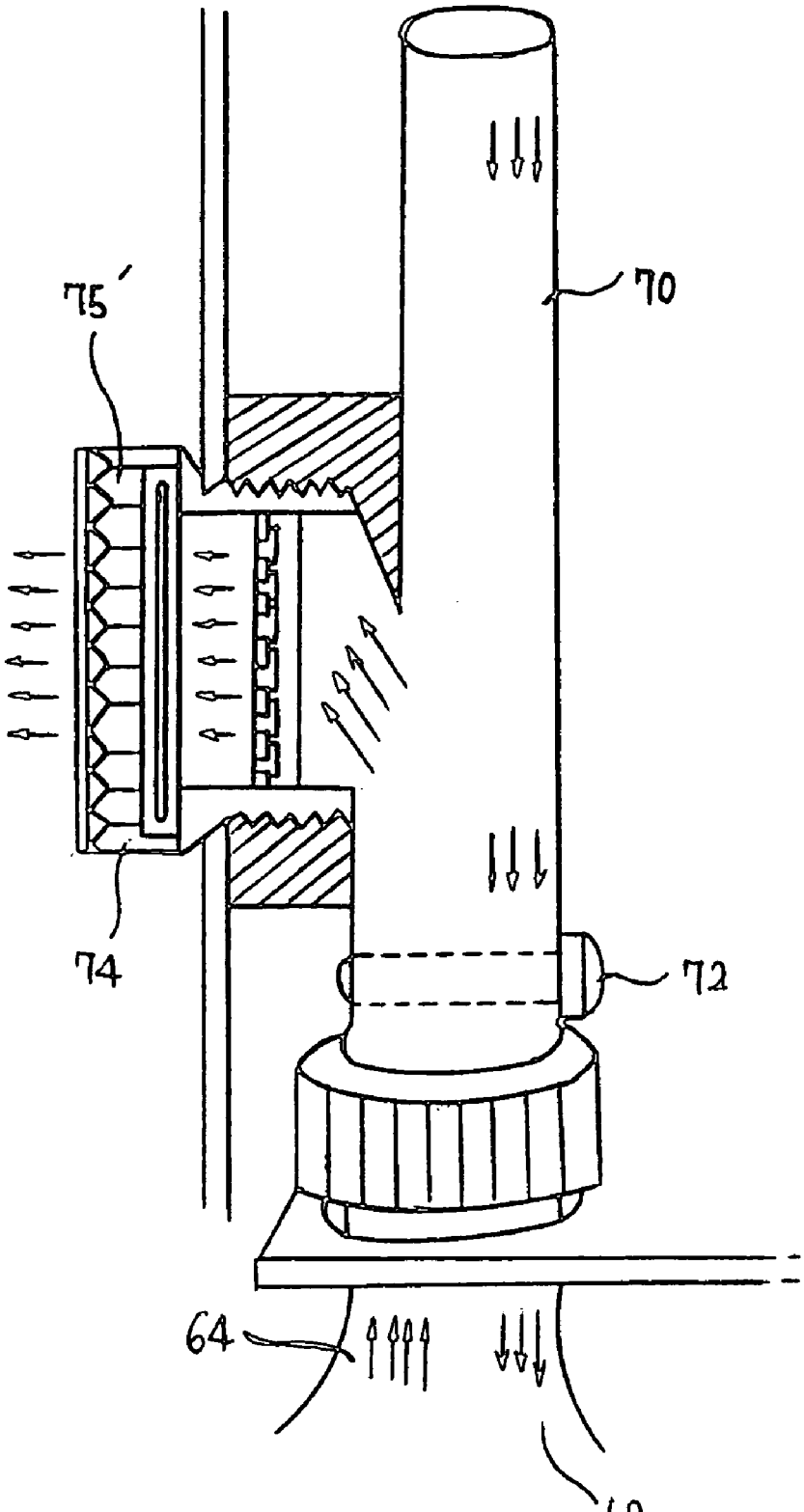
FIG. 9 is a cross sectional view of an exhaust port in accordance with the present invention.

The piston system 34 in the fluid reservoir 32 may include a piston 35, driven by a suitable piston engine 36, the piston 35 for extending from the rear of the fluid reservoir 32 progressively towards the spray pump 45 as fluid is dispensed by the spray pump 45 to maximize the amount of fluid available for dispensing from the fluid reservoir 32. Such progression can be seen by comparing FIG. 6 (where the piston 35 is fully retracted and the fluid reservoir 32 is empty) to FIG. 7 (where the piston is partially extended). In one embodiment the piston 35 includes sealed ends to ensure that no fluid escapes into the fluid reservoir 32 behind the piston 35.

Upon operation of the spray pump 45, the piston 35 moves progressively further forward to ensure that a consistent amount of fluid is available for the spray pump 45 to dispense. When the device 1 is turned off or in a standby mode the piston 35 is held in position. When the fluid reservoir 32 is emptied during operation, the piston 35 retracts to allow the operator to refill the fluid reservoir 32 and to ensure that no fluid is added to the fluid reservoir 32 by the operator with the piston 35 in an extended position. Once the fluid reservoir 32 is filled and replaced, the piston 35 moves forward to a ready position where it stays until the spray pump 45 is in operation.

In a further embodiment the interior of the fluid reservoir 32 may include shoulders 38 positioned within the fluid reservoir 32 towards the spray pump end of the fluid reservoir 32 to prevent further advancement of the piston 35 once the fluid reservoir 32 is emptied.

In a still further embodiment, a portion 39 of the exterior of the fluid reservoir 32 may be transparent to allow the operator to visually determine the remaining fluid in the fluid reservoir 32 and to see the advancement of the piston 35 to determine approximately when the fluid reservoir 32 may need refilling.

The piston 35 helps reduce the need for a powerful spray pump 45 as less pressure is required to dispense fluid from the fluid reservoir 32 as the fluid is more readily accessible by the spray pump 45.

Waste Storage System

The waste storage system 60 generally includes a waste storage compartment 62, the waste storage compartment 62 for housing a waste storage receptacle 64, the waste storage receptacle 64 is in fluid communication with the waste collection system 60 through a discharge hose 70 which connects the vacuum 100 to the waste storage compartment 62. In operation, waste travels through the discharge hose 70 by virtue of the force of the vacuum 100 and is then deposited within the waste storage receptacle 64.

Optionally, a one-way valve 72 or a plurality of one-way valves may be located in the interior of the discharge hose 70 to prevent waste within the discharge hose 70 from travelling back towards the vacuum 100.

The discharge hose 70 may also define a recess for allowing noxious fumes from the waste material to escape the discharge hose 70 and pass through an exhaust port 74 into the environment. The exhaust port 74 may include a filter 75 of various means known for purifying or absorbing noxious fumes such as a replaceable HEPA™ filter or a replaceable activated charcoal filter and may further include a replaceable scent device (not shown) such that the air expelled from the discharge hose 70 will have a pleasant aroma such as the smell of roses.

All of the waste material collected by the device 1 is stored within the waste storage receptacle 64. An indicator 66 located on the device 1 alerts an operator when the waste storage receptacle 64 is full. Further, the circuitry within the device (not shown) is programmed such that when a sensor (not shown) within the waste storage receptacle 64 determines that the waste storage receptacle 64 is full, in addition to alerting the operator, the vacuum 100 is automatically shut off and the one-way valve 72 or valves within the discharge hose 70 are closed to ensure that further waste material is not vacuumed into the device.

To discard a full waste storage receptacle 64 and replace it with an empty waste storage receptacle 64, an operator presses a discharge button (not shown) located on or near the waste storage compartment 62 to begin a sealing process to ensure that the waste storage receptacle 64 is sealed prior to the waste storage compartment 62 being opened. Once the waste storage receptacle 64 is sealed, the waste storage compartment 62 will automatically slide out from the device 1 thereby exposing the waste storage receptacle 64 for disposal. In another embodiment, the waste storage compartment 62 can be completely removed from the device 1 to ensure that the operator has no contact with the waste storage receptacle 64 during the disposal process. Once the full waste storage receptacle 64 is discarded, an empty waste storage receptacle 64 can be placed within the waste storage compartment 62 which is then placed in the device 1 causing the waste storage receptacle 64 to connect to the discharge hose 70.

Operation

The systems described above work together in a coordinated fashion during operation. More specifically, the operator switches the device 1 on using a control panel 80 located on the body of the device 1 which is connected to the circuitry within the device (not shown) for making various electrical operations available to the operator. Switching the device 1 on activates a two-way electric motor (not shown) causing the hinged coverlid 15 to open and deploying the intake nozzle 12. The coverlid 15 retracts into a recess in the device during operation. Once the intake nozzle 12 is fully deployed a switch (not shown) is activated which starts the vacuum 100 and opens the valve 72 or valves located within the collection hose 18 and within the discharge hose 70 (if applicable) and also starts the spray pump 45 to provide pressurized spray to the spray jet 19 located within the intake nozzle 12.

Figure 5:
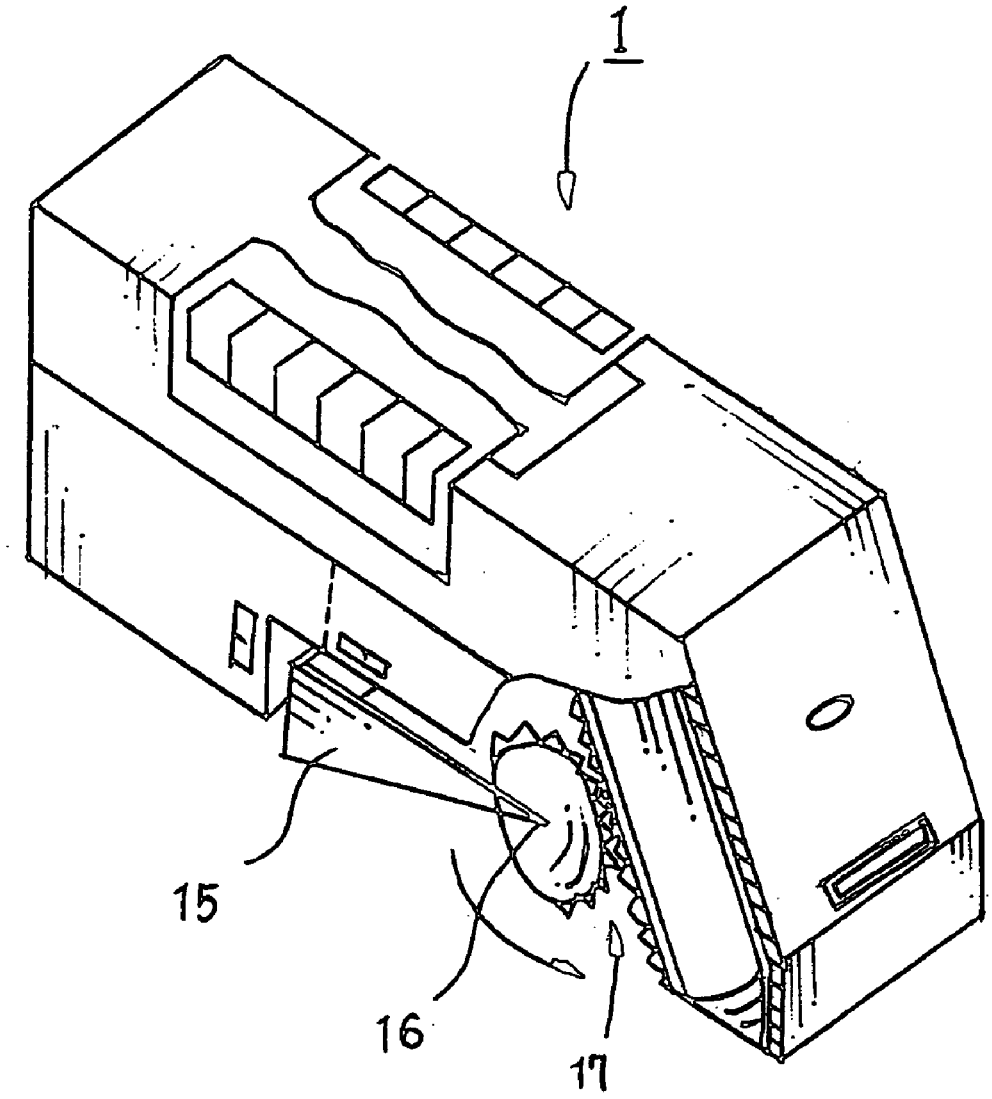
FIG. 5 is a perspective view of a device in accordance with the present invention.

In one embodiment, the coverlid 15 is in mechanical communication with the intake nozzle 12 through the use of a rack and pinion system 17 as shown in FIG. 5. The result is that as the coverlid 15 is opened through electrical means, the intake nozzle 12 will be mechanically moved to an operative extended position.

The operator places the intake nozzle 12 within the vicinity of the target waste materials. The material is vacuumed into the intake nozzle 12 as a result of the suction power of the vacuum 100 and travels through the collection hose 18 past the vacuum 100, through the discharge hose 70 and into the waste storage receptacle 64. As the material is sucked into the intake nozzle 12, it is sprayed by the spray jet 19 thereby enhancing the vacuum's ability to collect the material.

After all of the waste material has been vacuumed up, the operator switches off the device 1 which deactivates the vacuum 100 and the spray pump 45 and the closes the one-way valve 72 located within the collection hose 18. This activates the two-way electric motor causing the motor to close the coverlid 15 and retract the intake nozzle 12. Upon closure of the coverlid 15, a safety lock 85 is engaged to prevent opening of the coverlid 15 through inadvertence. The safety lock 85 also serves as a switch which starts the spray pump 45 for the purpose of supplying fluid to a spray jet 19 located within the cover lid 15 which then serves as a wash basin for cleaning off waste material from the intake nozzle 12 and cover grille 22. The spray jet 19 is activated for a predetermined period of time or for a predetermined volume of fluid to ensure proper cleaning of the intake nozzle 12 and cover grille 22. Once the cleaning of the intake nozzle 12 is complete, the spray pump 45 shuts off and the vacuum 100 is activated and the one-way valve 72 or valves located within either or (or both of) the collection hose 18 and discharge hose 70 are opened. This causes the mixed waste material and fluid in the washbasin to be vacuumed into the waste storage receptacle 64 along with the previously vacuumed waste material ensuring that the entire device 1 is automatically cleaned except for the interior of the waste storage receptacle 64. The vacuum shuts off automatically after a predetermined period of time at which point the one-way valve 72 or valves within either of (or both of) the collection hose 18 and the discharge hose 70 close and the device 1 is completely shut off.

Once the device 1 is completely shut off the device 1 is ready for additional use or, in the instance where the waste storage receptacle 64 has been completely filled, the operator may empty the waste storage compartment 62 and replace the filled waste storage receptacle 64 with an empty waste storage receptacle 64.

Leash System

The leash system 120 generally includes a leash 121 operatively connected to the body of the device. In one embodiment, the leash 121 is retractable within the housing of the body of the device and may include any one of a number of mechanisms designed to retract such leash material or more generally for retracting cords (not shown).

In another embodiment, the device 1 defines at least one housing 124 for retaining various types of retractable leash devices or includes at least one connector 128 to allow an operator to attach a regular leash to the device. In either of these embodiments the retractable leash device or leash may be easily detached by the operator to allow ordinary use of the retractable leash or use of the leash without the use of the device.

Figure 12:
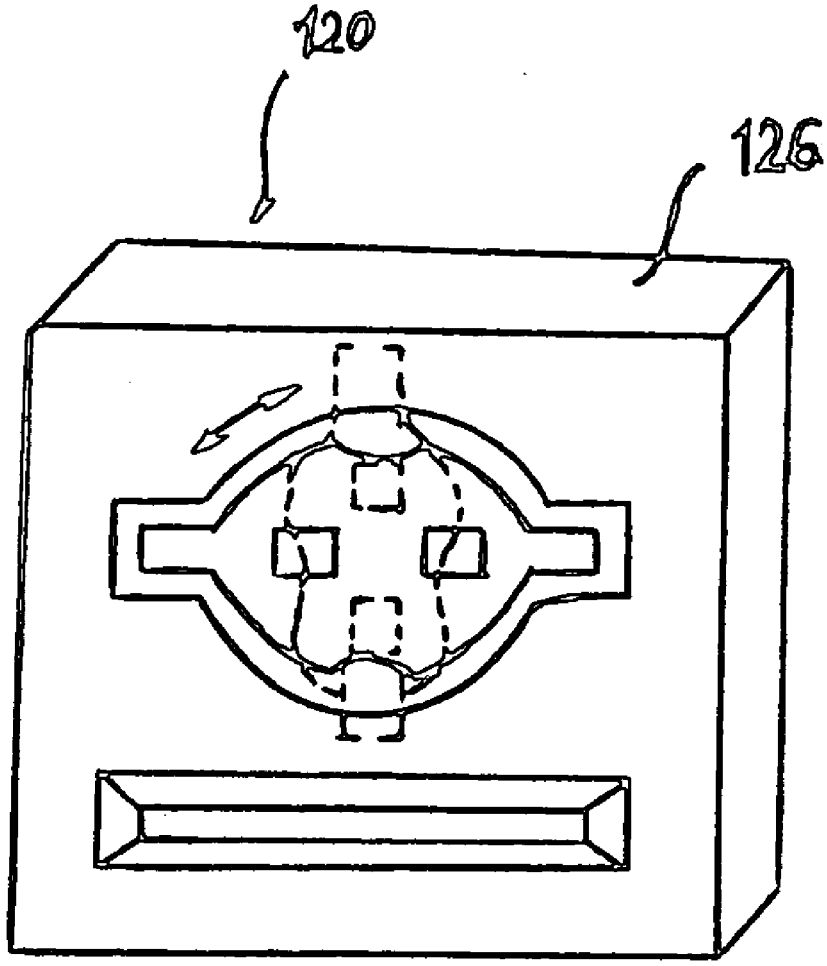
FIG. 12 is a perspective view of a leash system in accordance with the present invention.
Figure 13:
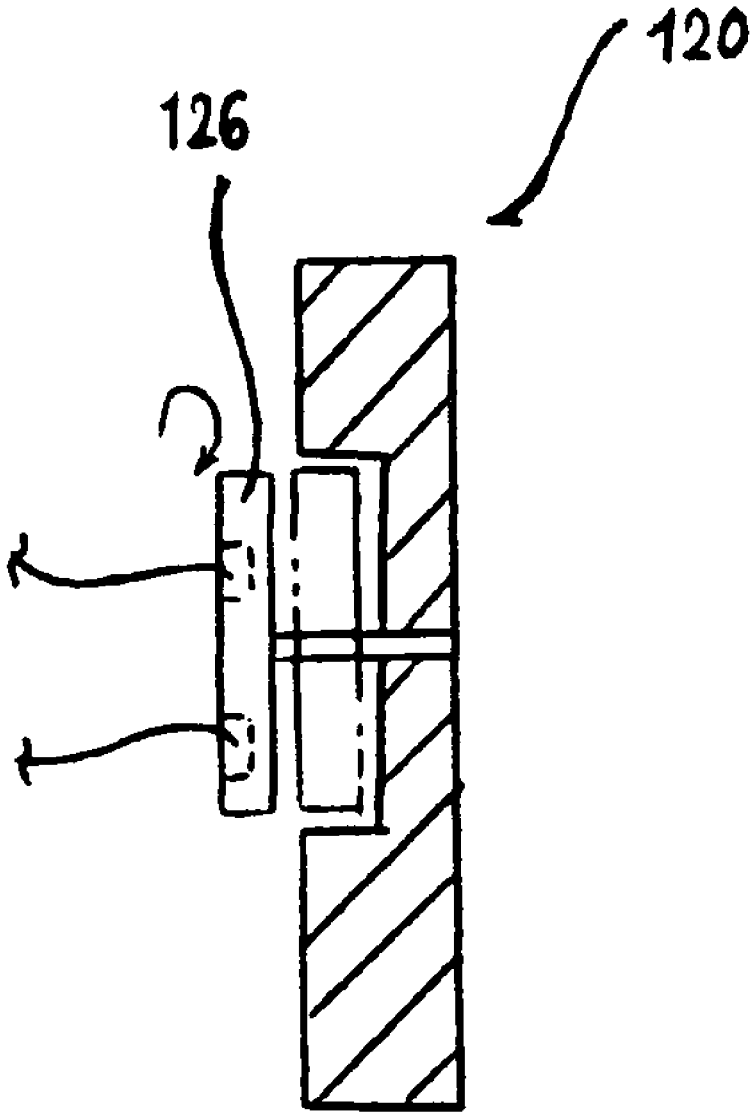

In a further embodiment, the device includes 1 a compartment 126 for storing two retractable or regular leashes 121. The compartment 126 includes a face or faceplate which allows the leases to extend from the compartment for connection to the operator's pets' collars. The face of the compartment, shown in FIG. 14, can freely rotate from side to side within the compartment 126 to allow the pets on the leash to cross each other's paths without the usual resulting entanglement of the pets' leashes. A further embodiment is shown in FIGS. 12 and 13.

Further Embodiments

The device is generally portable and may be handheld, wheeled or mounted on a vehicle such as a bicycle. The device may also be carried in a backpack or other casing for the added convenience of the operator.

Figure 10:
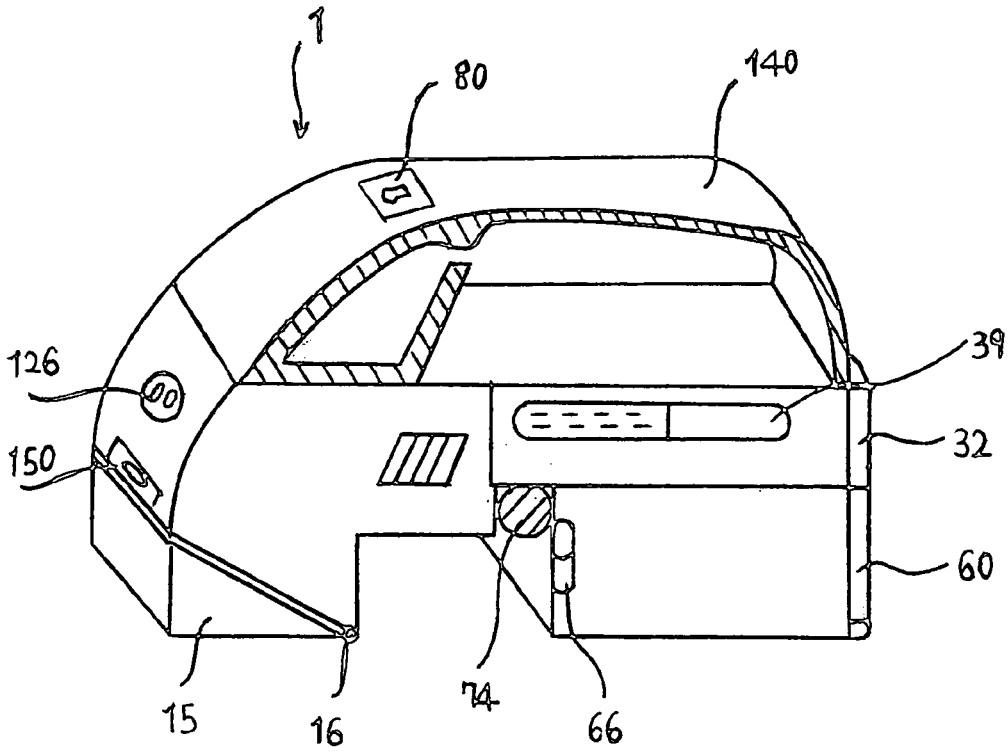
FIG. 10 is a perspective view of a device in accordance with the present invention.
Figure 11:
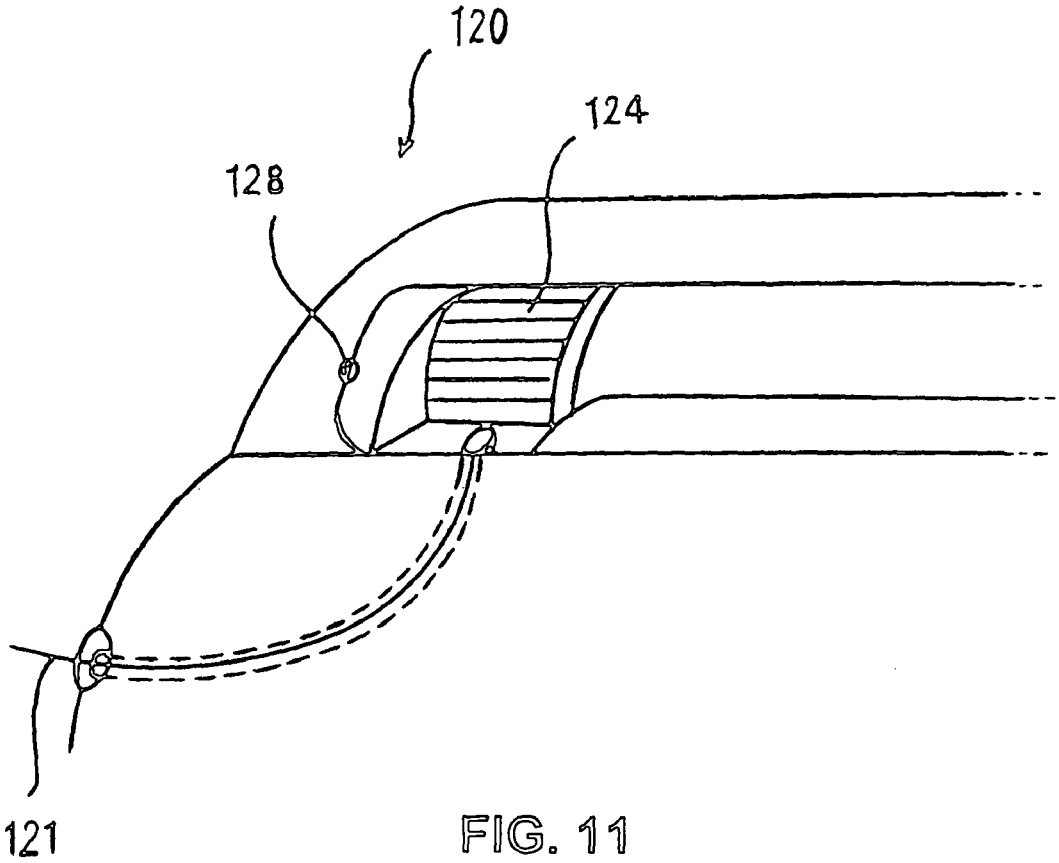
FIG. 11 is a perspective view of a leash system in accordance with the present invention.

The device includes one of a number of types of handles 140 (as illustrated in FIGS. 1 and 10) or straps (not shown) for the operator's carrying and use convenience.

The device may use a rechargeable dry cell battery (not shown) or other portable power means for providing the necessary power to the electric motor.

The device may optionally include a flashlight 150 for operation of the device in the dark.

What is claimed is:

1. A self-cleaning wet dry vacuum cleaning device comprising:

an intake nozzle for accepting waste into the device;

a vacuum in communication with the intake nozzle for providing suction to the intake nozzle, the intake nozzle moveable between an extended position during the collection of waste and a retracted position when the device is not collecting waste;

a removable waste storage compartment in communication with the vacuum for storing the waste vacuumed into the intake nozzle;

a passageway connecting the intake nozzle to the vacuum and the vacuum to the waste storage compartment;

a removable fluid reservoir for storing fluid, the fluid reservoir in fluid communication with the interior of the intake nozzle;

a spray pump in communication with the fluid reservoir for dispensing fluid from the fluid reservoir; and at least one spray jet in fluid communication with the fluid reservoir, the spray jet located in the interior of the intake nozzle to spray fluid in the intake nozzle to break up waste and to lubricate and clean the interior of the passageway.

2. A self-cleaning wet dry vacuum cleaning device comprising:

an intake nozzle for accepting waste into the device;

a vacuum in communication with the intake nozzle for providing suction to the intake nozzle;

a removable waste storage compartment in communication with the vacuum for storing the waste vacuumed into the intake nozzle;

a passageway connecting the intake nozzle to the vacuum and the vacuum to the waste storage compartment;

a removable fluid reservoir for storing fluid, the fluid reservoir in fluid communication with the interior of the intake nozzle;

a spray pump in communication with the fluid reservoir for dispensing fluid from the fluid reservoir; and a lid for covering the intake nozzle, the lid moveable between an open position while the device is vacuuming waste into the intake nozzle and a closed position for preventing waste from falling out of the intake nozzle.

3. A device as in claim 1 wherein the device includes a cover grille for covering the intake nozzle to prevent large materials from clogging the intake nozzle.

4. A device as in claim 1 wherein the waste storage compartment includes a disposable waste storage receptacle.

5. A device as in claim 1 wherein the passageway has at least one one-way valve to prevent waste within the passageway from travelling back towards the intake nozzle.

6. A device as in claim 1 wherein the passageway includes at least one exhaust port for exhausting fumes to the environment outside of the device.

7. A device as in claim 1 wherein the fluid reservoir includes a piston, the piston moveable between a retracted position and an extended position, the piston extending toward the spray pump as fluid is dispensed from the fluid reservoir by the spray pump to ensure that a consistent amount of fluid is available for the spray pump to dispense and to reduce the movement of fluid within the fluid reservoir.

8. A device as in claim 1 wherein the fluid reservoir includes an indicator for allowing an operator to visually determine the amount of fluid remaining in the fluid reservoir.

9. A self-cleaning wet dry vacuum cleaning device comprising:

an intake nozzle for accepting waste into the device;

a vacuum in communication with the intake nozzle for providing suction to the intake nozzle;

a removable waste storage compartment in communication with the vacuum for storing the waste vacuumed into the intake nozzle;

a passageway connecting the intake nozzle to the vacuum and the vacuum to the waste storage compartment;

a removable fluid reservoir for storing fluid, the fluid reservoir in fluid communication with the interior of the intake nozzle, wherein the fluid reservoir includes a removable straining basket for holding a concentrated bar of cleaner which dissolves as other fluid is added to the fluid reservoir to create a cleaning fluid in the reservoir; and a spray pump in communication with the fluid reservoir for dispensing fluid from the fluid reservoir.

10. A self-cleaning wet dry vacuum cleaning device comprising:

(a) an intake nozzle for accepting waste into the device;

(b) a lid for covering the intake nozzle, the lid moveable between an open position while the device is accepting waste through the intake nozzle and a closed position for preventing waste from falling out of the intake nozzle;

(c) a spray jet in fluid communication with the fluid reservoir located within the lid for cleaning the intake nozzle when the lid is in the closed position;

(d) a vacuum in communication with the intake nozzle for providing suction to the intake nozzle;

(e) a removable waste storage compartment in communication with the vacuum for storing the waste vacuumed into the intake nozzle;

(f) a passageway connecting the intake nozzle to the vacuum and the vacuum to the waste storage compartment;

(g) a removable fluid reservoir for storing fluid, the fluid reservoir in fluid communication with the interior of the intake nozzle; and (h) a spray pump in communication with the fluid reservoir for dispensing fluid from the fluid reservoir.

11. A device as in claim 10 wherein the lid includes a pinion which corresponds with a rack integrated with the intake nozzle, the rack and pinion operating together to ensure that the lid moves to the open position as the intake nozzle moves toward the extended position.

12. A device as in claim 3 wherein the cover grille is recessed within the intake nozzle, relative to the spray jet, to ensure that any materials discarded from the intake nozzle are cleaned by the spray jet within the intake nozzle prior to being discarded.

13. A device as in claim 1 wherein the waste storage compartment includes an indicator for allowing an operator to visually determine when the waste receptacle is full.

14. A device as in claim 1 wherein the waste storage compartment includes a sensor for determining when the waste storage compartment is full and for shutting off the device when the sensor determines that the waste storage compartment is full.

15. A device as in claim 6 wherein the exhaust port includes a replaceable filter for purifying or absorbing fumes.

16. A device as in claim 7 wherein the piston includes sealed ends to ensure that no fluid escapes into the fluid reservoir behind the piston.

17. A device as in claim 14 wherein the waste storage compartment includes an indicator in communication with the sensor for alerting a user when the waste receptacle is full.

18. A device as in claim 15 wherein the filter includes a replaceable scent device for ensuring that fumes exhausted through the exhaust port have a pleasant aroma.

19. A self-cleaning wet dry vacuum cleaning device comprising:

an intake nozzle for accepting waste into the device;

a vacuum in communication with the intake nozzle for providing suction to the intake nozzle;

a waste storage compartment in communication with the vacuum for storing the waste collected by the intake nozzle;

a passageway connecting the intake nozzle to the vacuum and the vacuum to the waste storage compartment;

a fluid reservoir for storing fluid, the fluid reservoir in fluid communication with the interior of the intake nozzle;

a spray pump in communication with the fluid reservoir for dispensing fluid from the fluid reservoir;

a leash system for retaining various types of retractable leash device; and a rotatable compartment for housing a plurality of retractable leashes, a faceplate for covering the compartment, the faceplate defining holes for allowing the retractable leashes through the faceplate, the compartment rotatable within the device for ensuring the leashes do not become entangled when the pets on the leash cross each other's path.

20. The device of claim 1, further comprising at least one spray jet in fluid communication with the fluid reservoir, the spray jet located in the interior of the passageway for spraying fluid in the passageway to break up waste and to lubricate and clean the interior of the passageway.

* * * * *